US010396452B2

(12) United States Patent
Takahashi et al.

(10) Patent No.: US 10,396,452 B2
(45) Date of Patent: Aug. 27, 2019

(54) DIELECTRIC SUBSTRATE AND ANTENNA DEVICE

(71) Applicant: Panasonic Intellectual Property Management Co., Ltd., Osaka (JP)

(72) Inventors: Ken Takahashi, Ishikawa (JP); Yuichi Kashino, Ishikawa (JP); Ryosuke Shiozaki, Tokyo (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 166 days.

(21) Appl. No.: 15/602,147

(22) Filed: May 23, 2017

(65) Prior Publication Data

US 2017/0346180 A1 Nov. 30, 2017

(30) Foreign Application Priority Data

May 31, 2016 (JP) ..... 2016-109197

(51) Int. Cl.
*H01Q 1/52* (2006.01)
*H01P 3/08* (2006.01)
(Continued)

(52) U.S. Cl.
CPC ..... *H01Q 1/528* (2013.01); *H01P 3/081* (2013.01); *H01Q 1/24* (2013.01); *H01Q 1/38* (2013.01);
(Continued)

(58) Field of Classification Search
CPC ..... H01Q 1/528; H01Q 1/38; H01Q 1/24; H01Q 1/42; H01Q 1/525; H01Q 9/045;
(Continued)

(56) References Cited

U.S. PATENT DOCUMENTS 5,898,405 A 4/1999 Iwasaki
6,218,989 B1 4/2001 Schneider et al.
(Continued)

FOREIGN PATENT DOCUMENTS

JP 2012-093305 5/2012
WO 1999/050929 10/1999
WO 2016/013790 A1 1/2016

OTHER PUBLICATIONS

Communication pursuant to Article 94(3) EPC dated, Aug. 17, 2018, for the related European Patent Application No. 17172170.7.
(Continued)

*Primary Examiner* — Rakesh B Patel
*Assistant Examiner* — Jorge L Salazar, Jr.
(74) *Attorney, Agent, or Firm* — Seed IP Law Group LLP

(57) ABSTRACT

A dielectric substrate for transmitting a signal with a frequency $f_0$ includes a dielectric and a copper film pattern arranged on a first surface of the dielectric. The copper film pattern has a first dimension L in a direction parallel to a propagation direction of an electromagnetic wave that has the frequency $f_0$ and that propagates on the first surface, and the first dimension L is given by:

$$L = \frac{1}{\sqrt{\varepsilon_r} - 1} k\lambda_0$$

where $\varepsilon_r$ represents a relative permittivity of the dielectric, k represents a constant in a range of 0.15 to 0.70, and $\lambda_0$ represents a free space wavelength of the signal.

15 Claims, 22 Drawing Sheets

(51) Int. Cl.

| | |
|---|---|
| ***H01Q 1/24*** | (2006.01) |
| ***H01Q 1/38*** | (2006.01) |
| ***H01Q 1/42*** | (2006.01) |
| ***H01Q 9/04*** | (2006.01) |
| *H01Q 21/00* | (2006.01) |

(52) U.S. Cl.
CPC ..... *H01Q 1/42* (2013.01); *H01Q 1/525* (2013.01); *H01Q 9/045* (2013.01); *H01Q 9/0407* (2013.01); *H01Q 9/0457* (2013.01); *H01Q 21/0075* (2013.01)

(58) Field of Classification Search
CPC ..... H01Q 21/0075; H01Q 9/0457; H01Q 9/0407; H01P 3/08; H01P 3/081; H01P 3/082; H01P 7/08; H01P 7/082
USPC ..... 333/161, 164, 204, 205, 238, 246
See application file for complete search history.

(56) References Cited

U.S. PATENT DOCUMENTS

| | | | | |
|---|---|---|---|---|
| 2007/0085626 | A1* | 4/2007 | Lee ..... | H01P 5/107 333/26 |
| 2012/0105300 | A1 | 5/2012 | Ando et al. | |
| 2016/0134021 | A1 | 5/2016 | Helander et al. | |
| 2017/0222314 | A1 | 8/2017 | Cho et al. | |

OTHER PUBLICATIONS

Thakur Samruddha et al: "Microstrip patch antenna array for Rainfall Radar", 2013 Fourth International Conference on Computing, Communications and Networking Technologies (ICCCNT), IEEE, Jul. 4, 2013, pp. 1-4, XP032560388.

Wenquan Che et al: "Formulas of dielectric and total attenuations of a microstrip line : Dielectric Loss of Microstrip Line", Radio Science., vol. 45, No. 5, Oct. 1, 2010, pp. n/a-n/a, XP055495176.

Pasternack: "Technical Data Sheet 034 Semi-rigid Coax Cable with Copper Outer Conductor", Dec. 13, 2013, XP055495186, Retrieved from the Internet: URL:https://www.pasternack.com/images/ProductPDF/PE-034SR.pdf.

Extended European Search Report, dated Oct. 20, 2017, for related European Patent Application No. 17172170.7-1927, 11 pages.

Lei Wang et al, "Wideband High-Gain 60-GHz LTCC L-Probe Patch Antenna Array With a Soft Surface", IEEE Transactions on Antennas and Propagation, vol. 61, No. 4, Apr. 2013, 8 pages.

Summons to attend oral proceedings pursuant to Rule 115(1) EPC dated May 28, 2019 for the related European Patent Application No. 17172170.7.

Maria Elena de Cos et al: "Dual-Band Uniplanar CPW-Fed Monopole/EBG Combination With Bandwidth Enhancement", IEEE Antennas and Wireless Propagation Letters, IEEE, Piscataway, NJ, US, vol. 11, Jan. 1, 2012, pp. 365-368, XP011489188.

* cited by examiner

10

DIELECTRIC SUBSTRATE AND ANTENNA DEVICE

BACKGROUND

1. Technical Field

The present disclosure relates to a dielectric substrate and an antenna device.

2. Description of the Related Art

When current flows in a conductor, electromagnetic waves are radiated. In particular, when current flows in an antenna or a transmission line on a dielectric substrate, unintended electromagnetic waves are radiated (unwanted radiation) and propagate on an obverse surface of the dielectric substrate, which may cause generation of null in antenna directivity or may cause interference, which is crosstalk noise.

Japanese Unexamined Patent Application Publication (Translation of PCT Application) No. 2002-510886 (herein referred to as "Patent Document 1") discloses a technology in which elements, each constituted by a hexagonal copper film pattern and a conductive via, are periodically arranged in the form of a two-dimensional mesh on a dielectric to thereby suppress or reduce electromagnetic waves that propagate on an obverse surface of a dielectric substrate. Japanese Unexamined Patent Application Publication No. 2012-93305 (herein referred to as "Patent Document 2") discloses a technology in which a radome with an upright wall that provides shielding between a transmitting antenna and a receiving antenna formed on a dielectric to thereby suppress or reduce electromagnetic waves that propagate on an obverse surface of a dielectric substrate from the transmitting antenna to the receiving antenna.

However, in Patent Document 1, the conductive vias need to be arranged on the obverse surface of the dielectric substrate, and thus, when a control circuit or the like is mounted on a reverse surface of the dielectric substrate, the arranged conductive vias limit an area where the control circuit or the like can be configured, and when an antenna device is configured as a module including a dielectric substrate and a control circuit, the module size may increase. Also, in Patent Document 2, it is necessary to add the radome in addition to the dielectric substrate, the structure size increases, and the cost increases.

SUMMARY

One non-limiting and exemplary embodiment facilitates providing a dielectric substrate and an antenna device that can suppress or reduce electromagnetic waves that propagate on a dielectric substrate, while avoiding an increase in the structure size.

In one general aspect, the techniques disclosed here feature a dielectric substrate for transmitting a signal with a frequency $f_0$. The dielectric substrate includes a dielectric and a copper film pattern arranged on a first surface of the dielectric. The copper film pattern has a first dimension L in a direction parallel to a propagation direction of an electromagnetic wave that has the frequency $f_0$ and that propagates on the first surface, and the first dimension L is given by:

$$L = \frac{1}{\sqrt{\varepsilon_r} - 1} k\lambda_0$$

where $\varepsilon_r$ represents a relative permittivity of the dielectric, k represents a constant in a range of 0.15 to 0.70, and $\lambda_0$ represents a free space wavelength of the signal.

According to the present disclosure, it is possible to suppress or reduce electromagnetic waves that propagate on a dielectric substrate, while avoiding an increase in the structure size.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
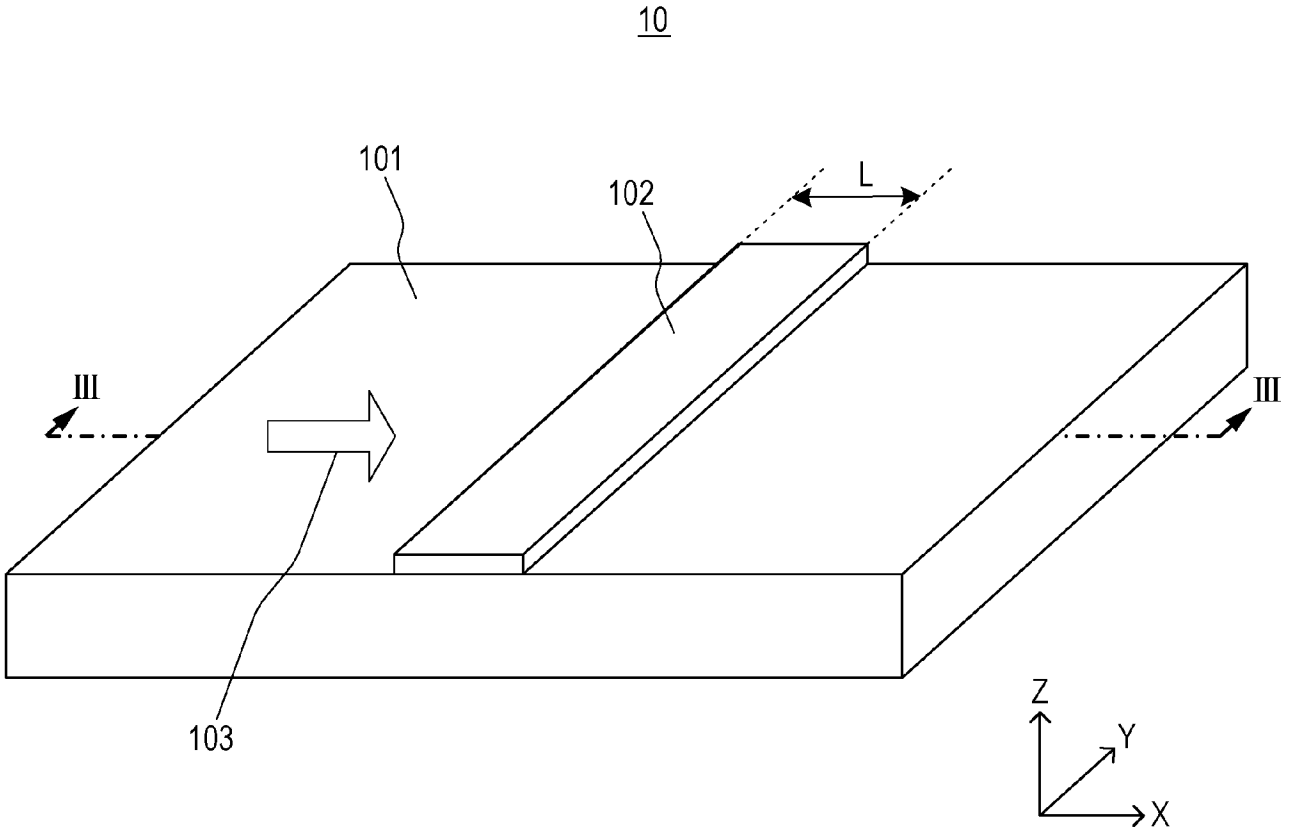
FIG. 1 is a perspective view illustrating a dielectric substrate according to a first embodiment.

Embodiments of the present disclosure will be described below in detail with reference to the accompanying drawings. Each of the embodiments described below is an example, and the present disclosure is not limited to the embodiments. In the following description, the same or similar constituent elements are denoted by the same reference numerals.

First Embodiment

Figure 2:
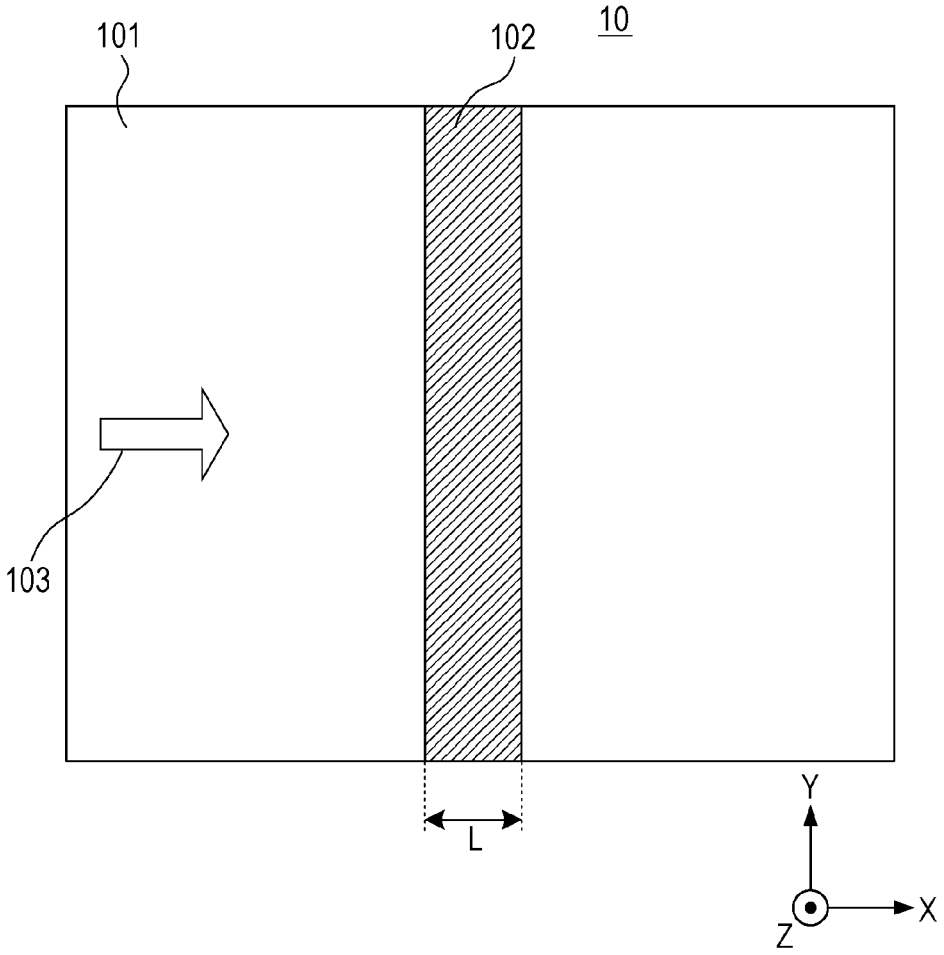
FIG. 2 is a plan view illustrating the dielectric substrate according to the first embodiment.
Figure 3:
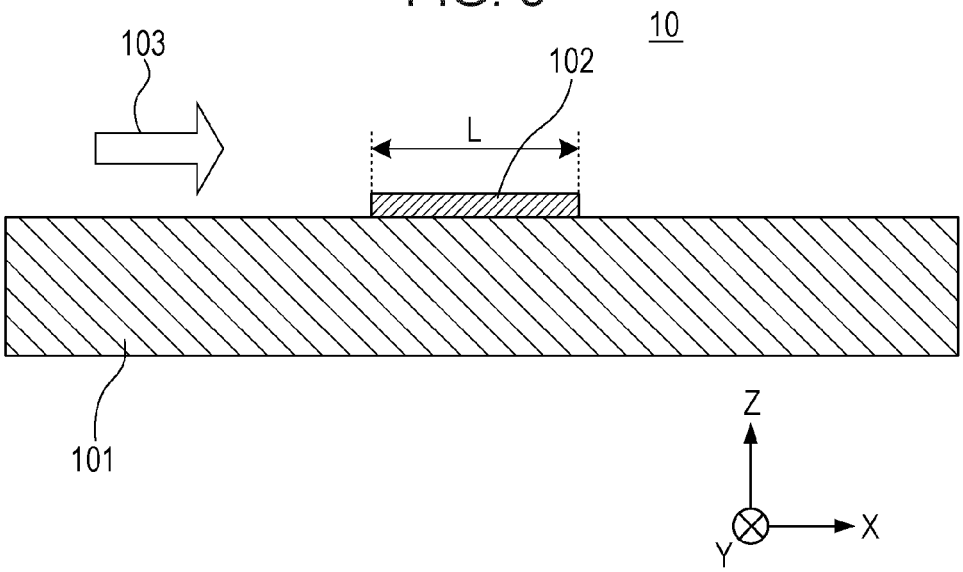
FIG. 3 is a transverse sectional view illustrating the dielectric substrate according to the first embodiment.

FIG. 1 is a perspective view illustrating the configuration of a dielectric substrate 10 according to a first embodiment of the present disclosure. FIG. 2 is a plan view of the dielectric substrate 10 according to the first embodiment of the present disclosure. FIG. 3 is a sectional view, taken along line III-III, of the dielectric substrate 10 illustrated in FIG. 1.

The dielectric substrate 10 according to the present embodiment transmits signals with a frequency $f_0$. The dielectric substrate 10 has a dielectric 101 and a copper film pattern 102. The dielectric substrate 10 may be used, for example, in a radar device.

As illustrated in FIG. 1, the copper film pattern 102 is arranged on an obverse surface (corresponding to a first surface) of the dielectric 101. The copper film pattern 102 is also arranged so as to have a first dimension L in a direction parallel to a propagation direction 103 (in FIGS. 1 to 3, in an X-axis direction) of electromagnetic waves that have the frequency $f_0$ and that propagate on an obverse surface of the dielectric substrate 10. The electromagnetic waves with the frequency $f_0$ are, for example, electromagnetic waves (unwanted radiation) radiated when current flows in an antenna or a transmission line connected to the dielectric substrate 10 (or provided on the dielectric substrate 10).

The first dimension L of the copper film pattern 102 is given by:

$$L = \frac{1}{\sqrt{\varepsilon_r} - 1} k\lambda_0 \tag{1}$$

In equation (1), $\varepsilon_r$ represents a relative permittivity of the dielectric 101, k represents a constant in the range of 0.15 to 0.70, and $\lambda_0$ represents a free space wavelength of signals transmitted on the dielectric substrate 10.

That is, in the present embodiment, the first dimension L of the copper film pattern 102 is determined by the frequency $f_0$ of signals transmitted on the dielectric substrate 10 and the relative permittivity $\varepsilon_r$ of the dielectric 101.

Figure 4:
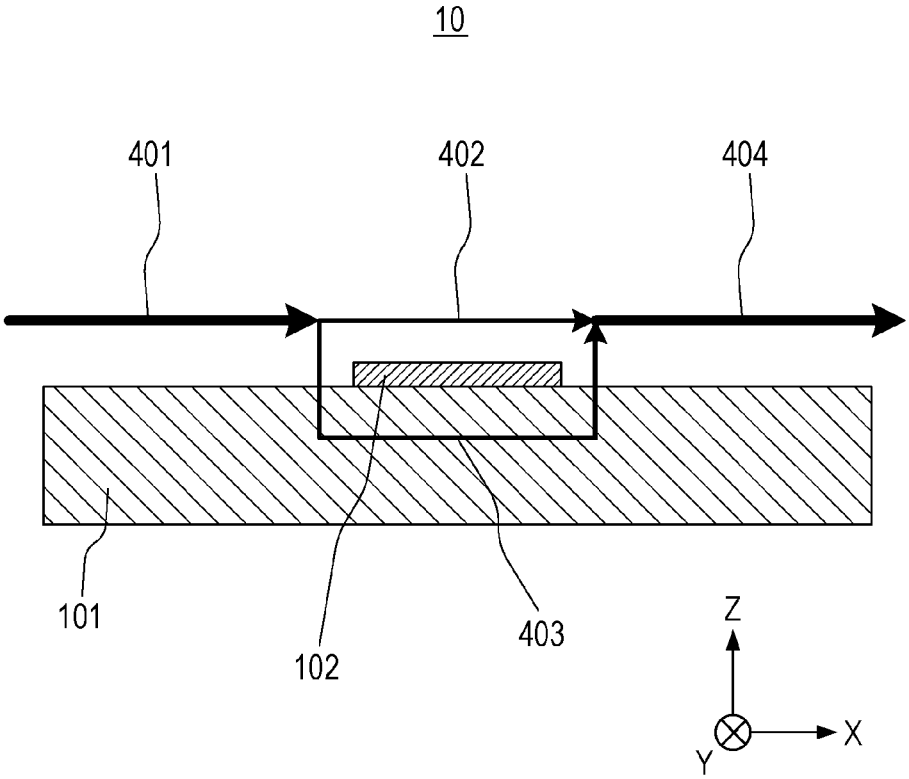
FIG. 4 is a view illustrating paths through which electromagnetic waves propagate along the dielectric substrate according to the first embodiment.

FIG. 4 illustrates propagation paths when electromagnetic waves that propagate on the obverse surface of the dielectric substrate 10 pass on the copper film pattern 102. As illustrated in FIG. 4, when electromagnetic waves that propagate along one path 401 on the obverse surface of the dielectric substrate 10 pass on the copper film pattern 102, the electromagnetic waves split to and propagate through a path 402 above the copper film pattern 102 and a path 403 below the copper film pattern 102. After the electromagnetic waves pass on the copper film pattern 102, the electromagnetic waves propagate along one path 404 above the obverse surface of the dielectric substrate 10.

In this case, when the first dimension L of the copper film pattern 102 in the electromagnetic-wave propagation direction 103 is set to the value in equation (1), electromagnetic waves that have propagated along the respective paths 402 and 403 have phases that are opposite to each other path. Hence, when the electromagnetic waves that have propagated along the respective paths 402 and 403 propagate along one path again, that is, a path 404, the electromagnetic waves that have propagated along the respective paths 402 and 403 cancel each other out. Thus, the electromagnetic waves that propagate on the obverse surface of the dielectric substrate 10 attenuate on the path 404. As a result, the electromagnetic waves that propagate on the dielectric 101 are suppressed or reduced by the copper film pattern 102.

The present inventors analyzed the amount of attenuation of the electromagnetic waves that propagate on the obverse surface of the dielectric substrate 10 illustrated in FIG. 1 by performing electromagnetic-field simulation using a finite integration method. The electromagnetic-field simulation was performed with respect to three types of relative permittivity ($\varepsilon_r$ is 2.0, 3.4, and 7.0), assuming three types of actually existing dielectric 101 (polytetrafluoroethylene (PTFE), polyphenylene ether (PPE), and low temperature co-fired ceramic (LTCC)).

Figure 5:
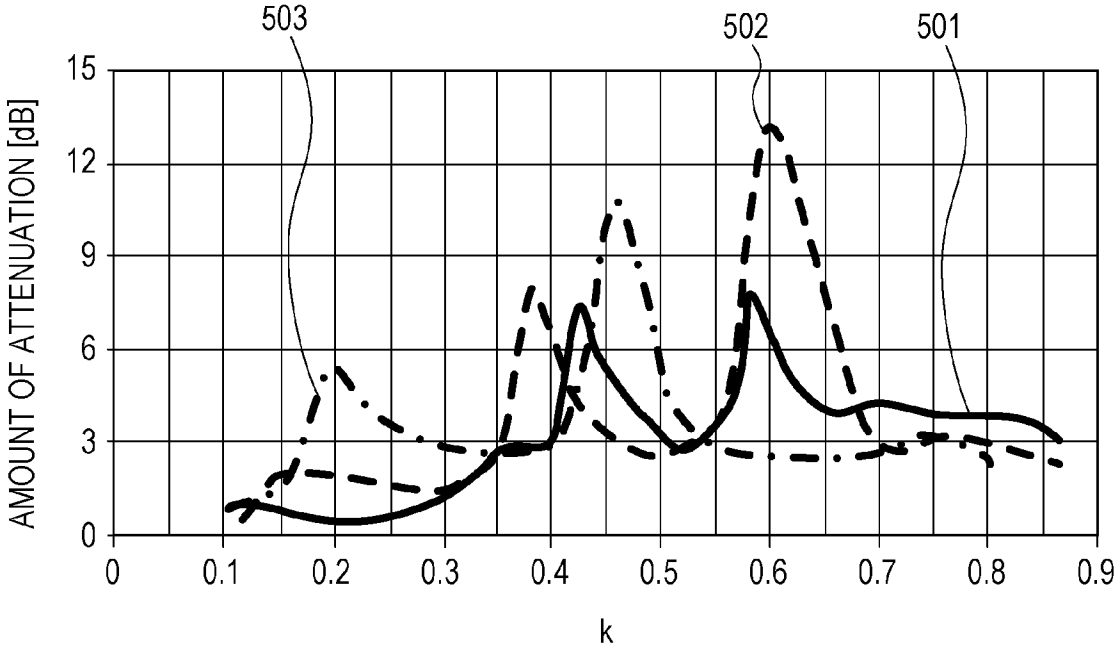
FIG. 5 is a graph illustrating a result of electromagnetic-field simulation that analyzes the amount of attenuation of electromagnetic waves that propagate on the dielectric substrate according to the first embodiment.

FIG. 5 is a graph illustrating a result of the electromagnetic-field simulation. In FIG. 5, the horizontal axis represents a constant k, and the vertical axis represents the amount of attenuation [dB] of the electromagnetic waves that propagate on the obverse surface of the dielectric substrate 10. In addition, in FIG. 5, a characteristic 501 represents a characteristic of the amount of attenuation for the relative permittivity $\varepsilon_r$=2.0, a characteristic 502 represents a characteristic of the amount of attenuation for the relative permittivity $\varepsilon_r$=3.4, and a characteristic 503 represents a characteristic of the amount of attenuation for the relative permittivity $\varepsilon_r$=7.0.

FIG. 5 shows that, in the range of k=0.15 to 0.70, the amount of attenuation of the electromagnetic waves that propagate on the obverse surface of the dielectric substrate 10 increases. The reason why the value of k at which the amount of attenuation increases differs depending on the value of the relative permittivity $\varepsilon_r$ is that the effective value of L differs owing to a fringing effect.

Also, in the electromagnetic-field simulation result illustrated in FIG. 5, in the range of k=0.15 to 0.70, for example, in the vicinity of k=0.3, the effect of increasing the amount of attenuation decreases. This is because the analysis in the electromagnetic-field simulation is performed using only three types of relative permittivity (i.e., $\varepsilon_r$ is 2.0, 3.4, and 7.0) by way of example, and in the range of the relative permittivity $\varepsilon_r$=2.0 to 7.0, other relative permittivities at which the amount of attenuation increases, for example, in the vicinity of k=0.3 exist. In other words, k=0.15 and k=0.7 are the minimum value and the maximum value, respectively, of the constant k at which the copper film pattern 102 can provide an effect of increasing the amount of attenuation of the electromagnetic waves, and a characteristic in which the amount of attenuation of the electromagnetic waves increases in the range of k=0.15 to 0.70 according to the relative permittivity $\varepsilon_r$ of the dielectric 101 is obtained.

In addition, FIG. 5 also illustrates an effect of increasing the amount of attenuation outside the range of k=0.15 to 0.70, and this effect is due to the arrangement of the copper film pattern 102.

Thus, it can be understood from FIG. 5 that, in the range of k=0.15 to 0.70, the copper film pattern 102 having the first dimension L provides an effect of suppressing or reducing the electromagnetic waves in the propagation direction 103.

As described above, in the present embodiment, the dielectric substrate 10 has the copper film pattern 102 on the obverse surface of the dielectric 101. Also, in accordance with equation (1), the first dimension L of the copper film pattern 102 in the propagation direction 103 of the electromagnetic waves on the obverse surface of the dielectric substrate 10 is set depending on the frequency $f_0$ (i.e., the wavelength $\lambda_0$) of the electromagnetic waves that propagate on the dielectric substrate 10. More specifically, the first dimension L is set so that the phases of electromagnetic waves that propagate along the path 402 above the copper film pattern 102 and the path 403 below the copper film pattern 102 after splitting thereto have opposite phases on the path 404.

With this arrangement, the dielectric substrate 10 makes it possible to suppress or reduce electromagnetic waves that propagate on the obverse surface of the dielectric substrate 10. Hence, for example, when the copper film pattern 102 is provided around an antenna or a transmission line on the dielectric substrate 10 according to the present embodiment, it is possible to suppress or reduce unwanted electromagnetic waves (unwanted radiation) from the antenna or the transmission line. Alternatively, when the copper film pattern 102 is provided between a plurality of antennas or between a plurality of transmission lines on the dielectric substrate 10 according to the present embodiment, it is possible to improve isolation between the antennas or between the transmission lines.

Also, according to the present embodiment, since the dielectric substrate 10 has the copper film pattern 102 on the obverse surface of the dielectric 101, it is possible to suppress or reduce unwanted electromagnetic waves that propagate on the obverse surface of the dielectric substrate 10. That is, in order to suppress or reduce the electromagnetic waves, the dielectric substrate 10 according to the present embodiment does not need to have an additional member, such as a conductive via as disclosed in Patent Document 1 or a radome as disclosed in Patent Document 2. Accordingly, for example, even when a control circuit or the like is mounted on a reverse surface of the dielectric substrate 10, it is possible to obtain an area for configuring the control circuit or the like. Hence, according to the present embodiment, even when a module including the dielectric substrate 10 is configured, the module can be miniaturized, and there are also an advantage in that the module can be produced at low cost.

Thus, according to the present embodiment, the dielectric substrate 10 makes it possible to suppress or reduce electromagnetic waves that propagate on the obverse surface of the dielectric substrate 10, while avoiding an increase in the structure size.

Variation of First Embodiment

Figure 6:
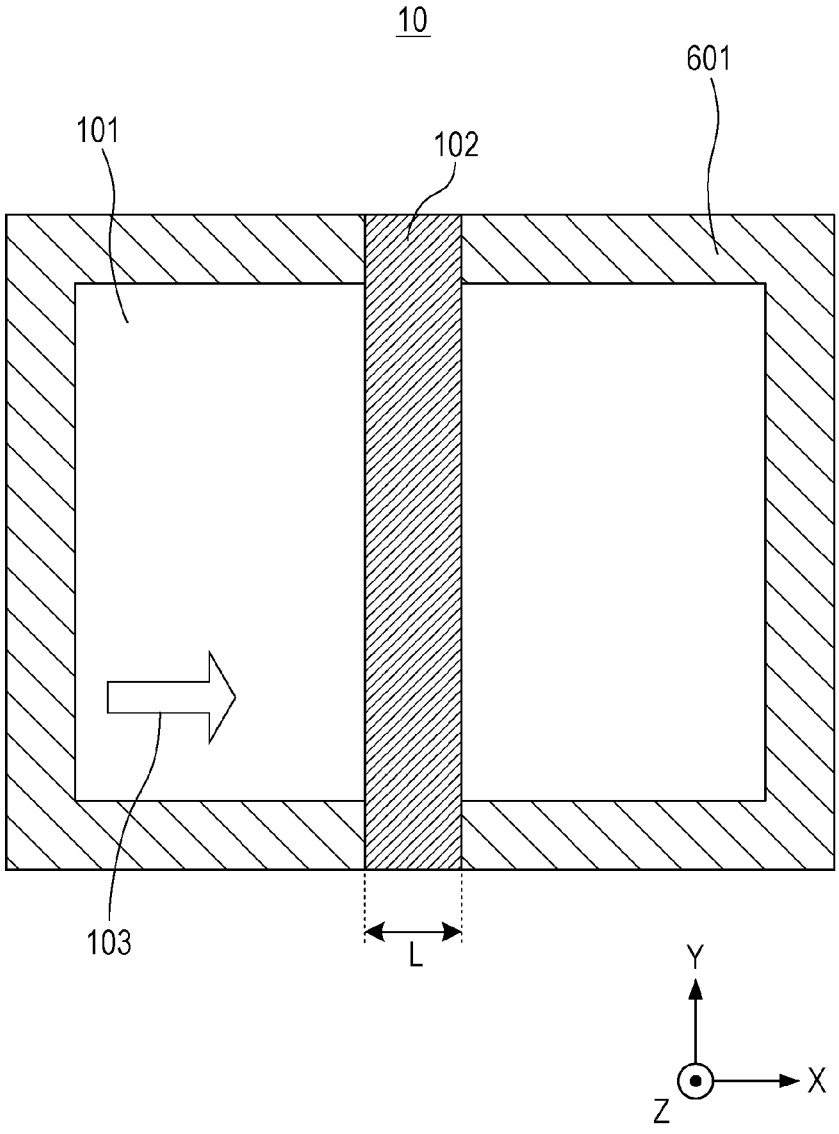
FIG. 6 is a plan view illustrating another example of the dielectric substrate according to the first embodiment.

The dielectric substrate 10 according to the present embodiment may have a configuration in which a ground pattern 601 is provided and a copper film pattern 102 is connected to the ground pattern 601 therearound, as illustrated in FIG. 6. Even when the dielectric substrate 10 is configured as illustrated in FIG. 6, advantages that are the same as or similar to the advantages when the dielectric substrate 10 is configurated as illustrated in FIG. 1 are also obtained.

Figure 7:
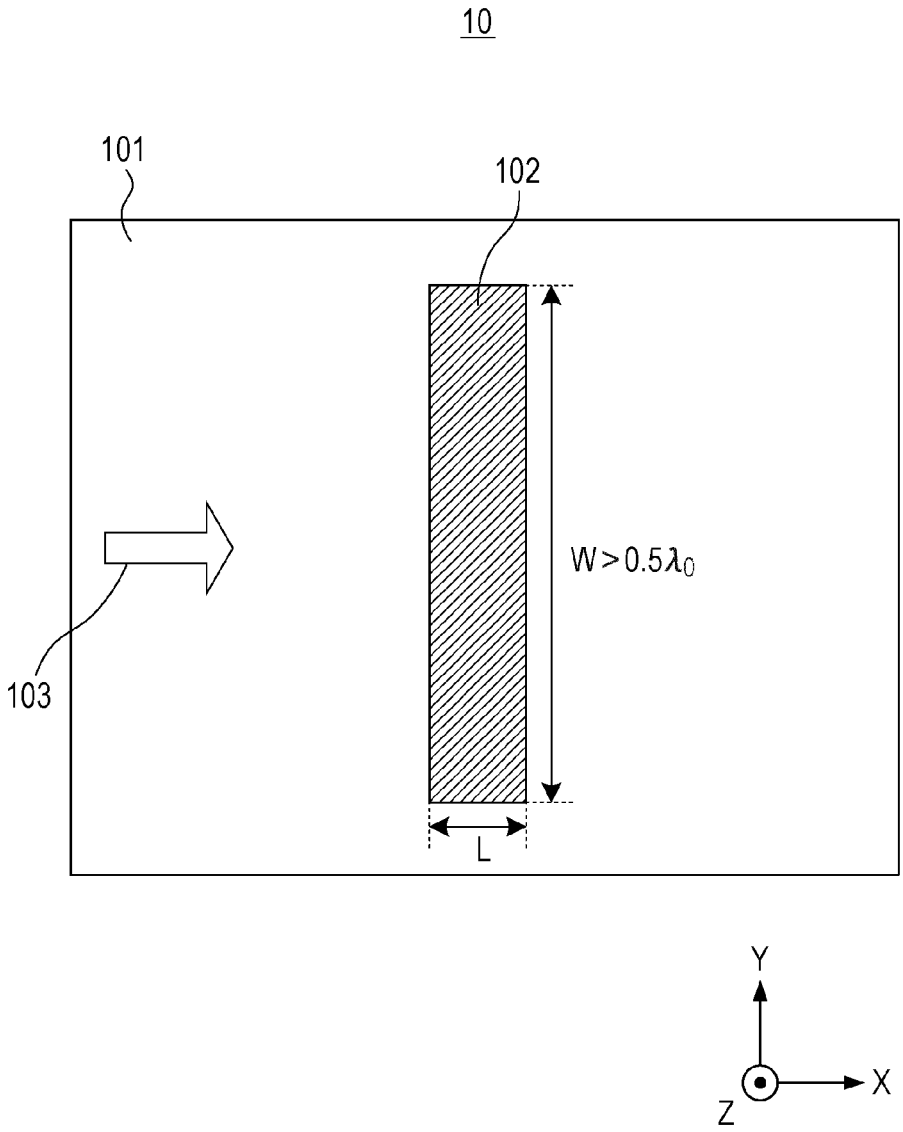
FIG. 7 is a plan view illustrating another example of the dielectric substrate according to the first embodiment.

In addition, the copper film pattern 102 on the dielectric substrate 10 according to the present embodiment has a second dimension W in a direction (a Y-axis direction) orthogonal to the electromagnetic-wave propagation direction 103, and the present embodiment is not limited to a case in which the second dimension W is substantially the same as that of the dielectric 101 (e.g., see FIG. 2). For example, the second dimension W of the copper film pattern 102 may be any dimension that satisfies $W>0.5\lambda_0$, that is, a condition that the second dimension W is larger than a half wavelength of signals with the frequency $f_0$, as illustrated in FIG. 7.

Figure 8:
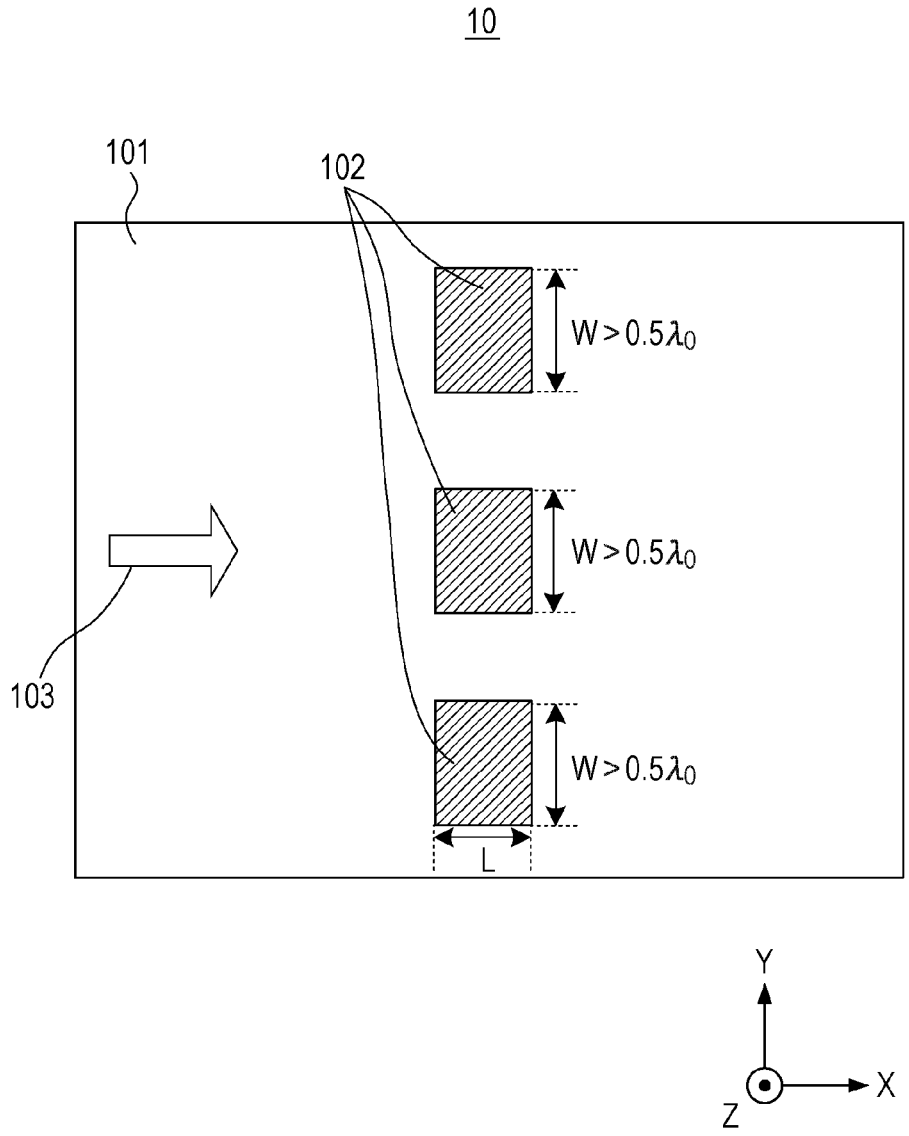
FIG. 8 is a plan view illustrating another example of the dielectric substrate according to the first embodiment.

In addition, in the dielectric substrate 10 according to the present embodiment, a plurality of copper film patterns 102 may be arranged on the obverse surface of the dielectric 101, as illustrated in FIG. 8. For example, a plurality of copper film patterns 102 may be arranged at portions where electromagnetic waves that propagate on the obverse surface of the dielectric 101 concentrate. In FIG. 8, it is sufficient that the second dimension W of each copper film pattern 102 in the Y-axis direction satisfies $W>0.5\lambda_0$, as in the case in FIG. 7.

Figure 9:
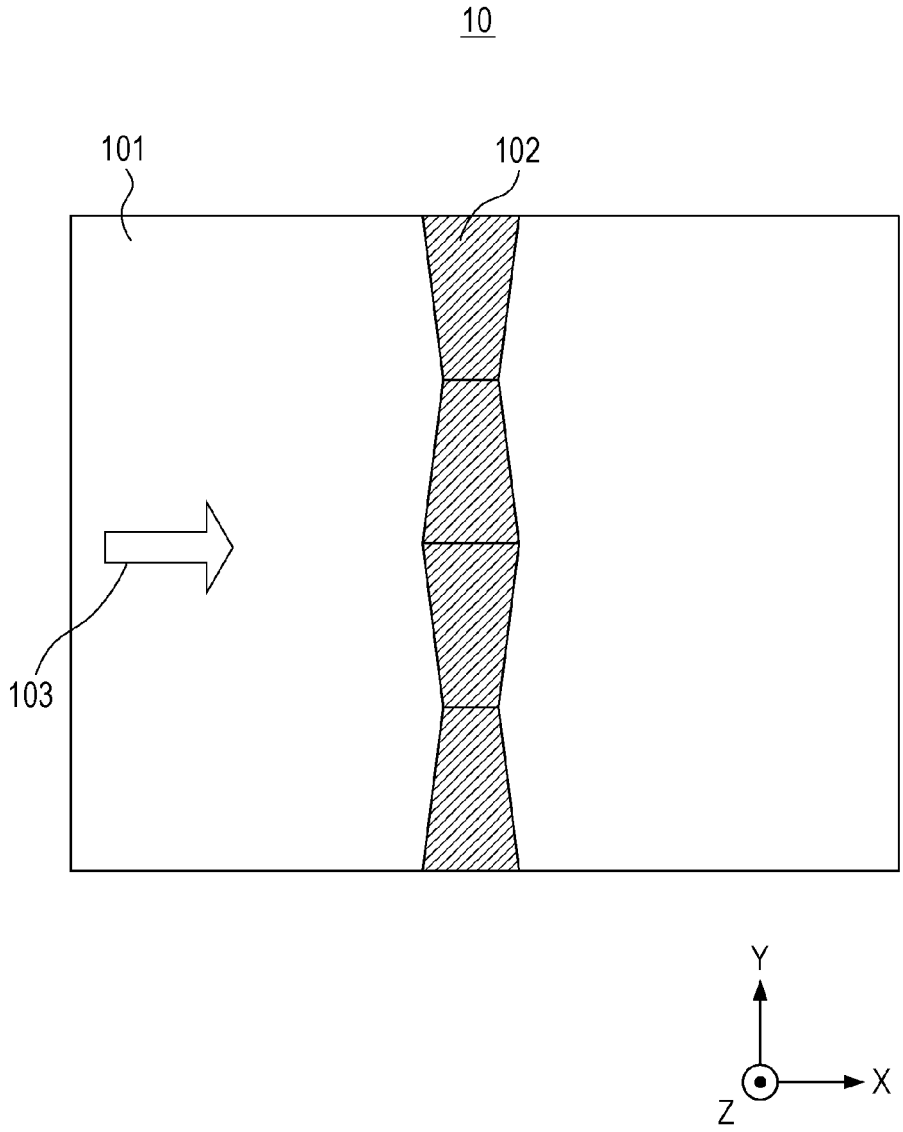
FIG. 9 is a plan view illustrating another example of the dielectric substrate according to the first embodiment.
Figure 10:
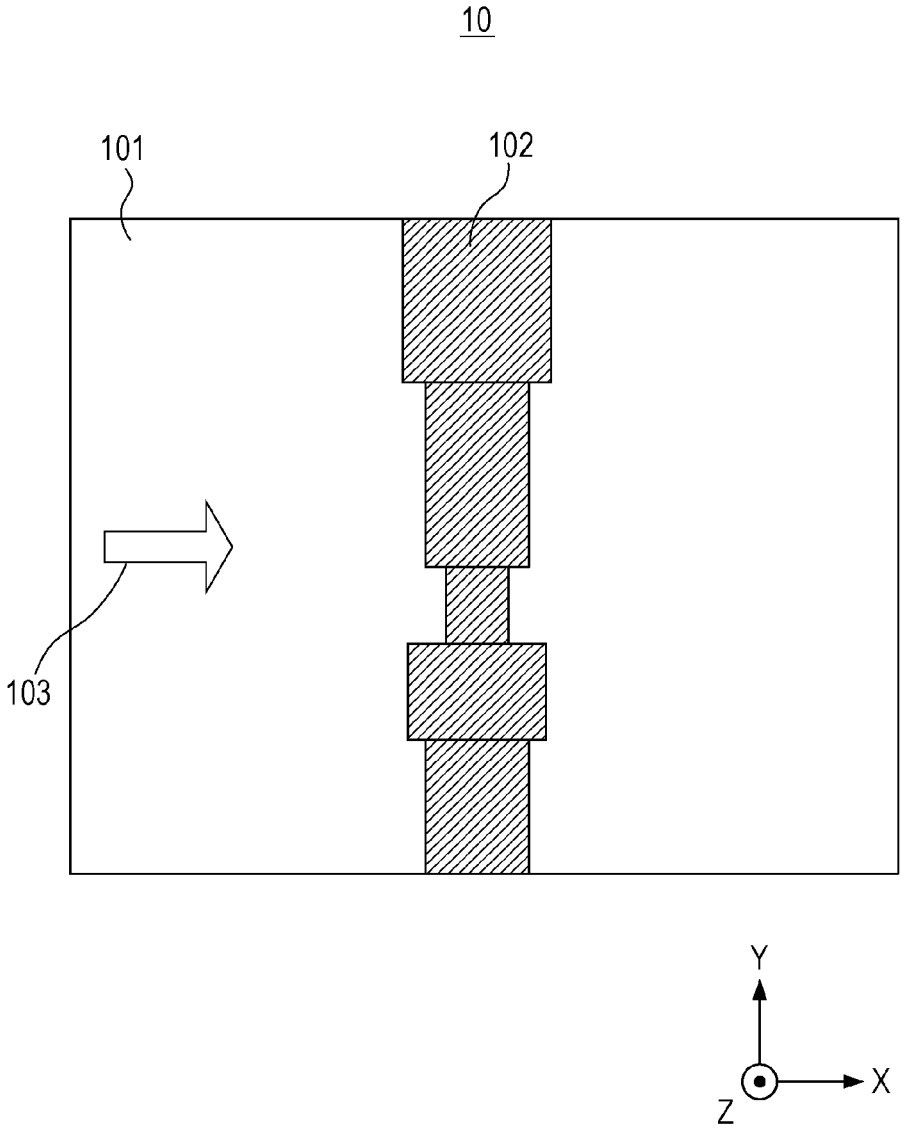
FIG. 10 is a plan view illustrating another example of the dielectric substrate according to the first embodiment.

Also, in the dielectric substrate 10 according to the present embodiment, the first dimension of the copper film pattern 102 in the electromagnetic-wave propagation direction 103 may be ununiform, as illustrated in FIG. 9 or 10. With such an arrangement, the dielectric substrate 10 can suppress or reduce electromagnetic waves with respect to signals with a different frequency $f_0$ (the wavelength $\lambda_0$), in accordance with the range of values taken by the first dimension of the copper film pattern 102 in the electromagnetic-wave propagation direction 103. That is, when the dielectric substrate 10 is configurated as illustrated in FIG. 9 or 10, it is possible to increase the frequency band in which the effect of suppressing or reducing electromagnetic waves is obtained.

Figure 11:
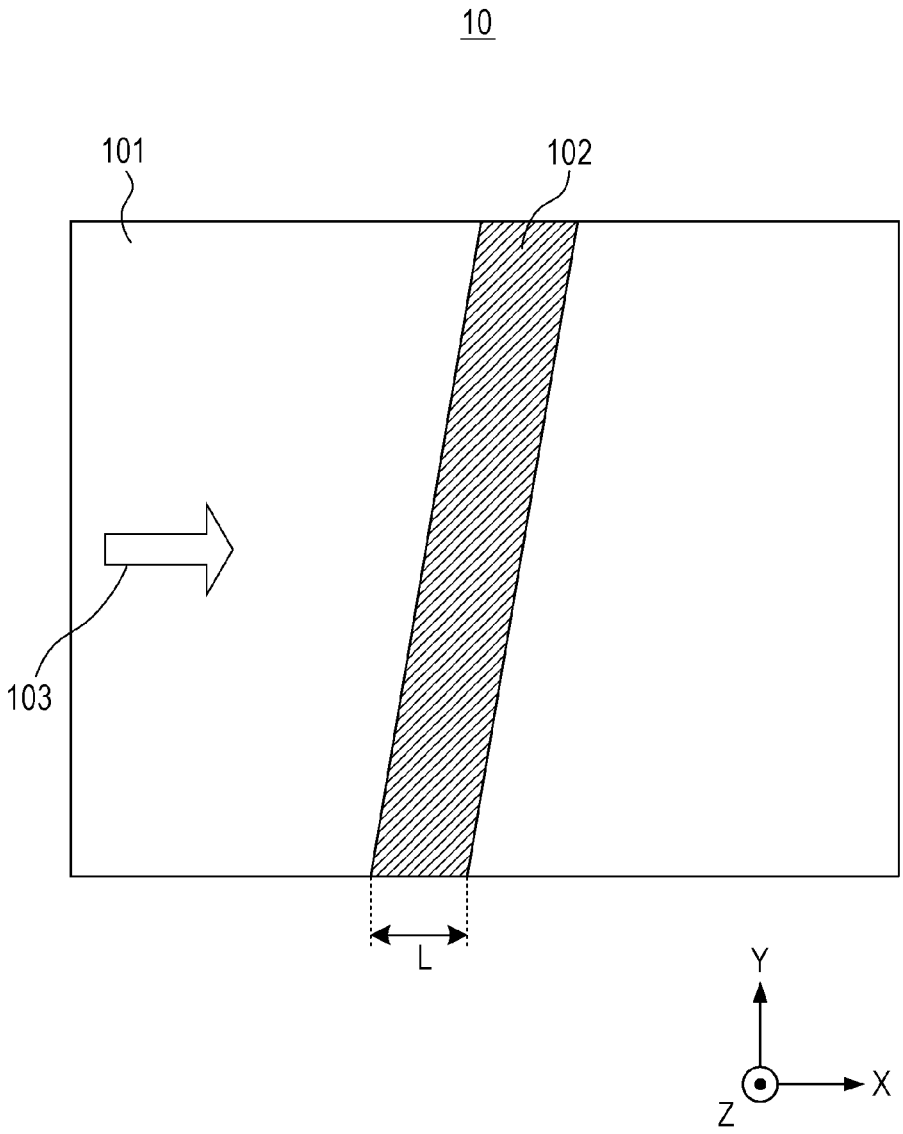
FIG. 11 is a plan view illustrating another example of the dielectric substrate according to the first embodiment.

Also, in the dielectric substrate 10 according to the present embodiment, the copper film pattern 102 is not limited to a pattern that extends in the direction (the Y-axis direction) orthogonal to the electromagnetic-wave propagation direction 103 (the X-axis direction), as illustrated in FIG. 2, and may be, for example, a pattern that extends obliquely, as illustrated in FIG. 11.

Second Embodiment

Figure 12:
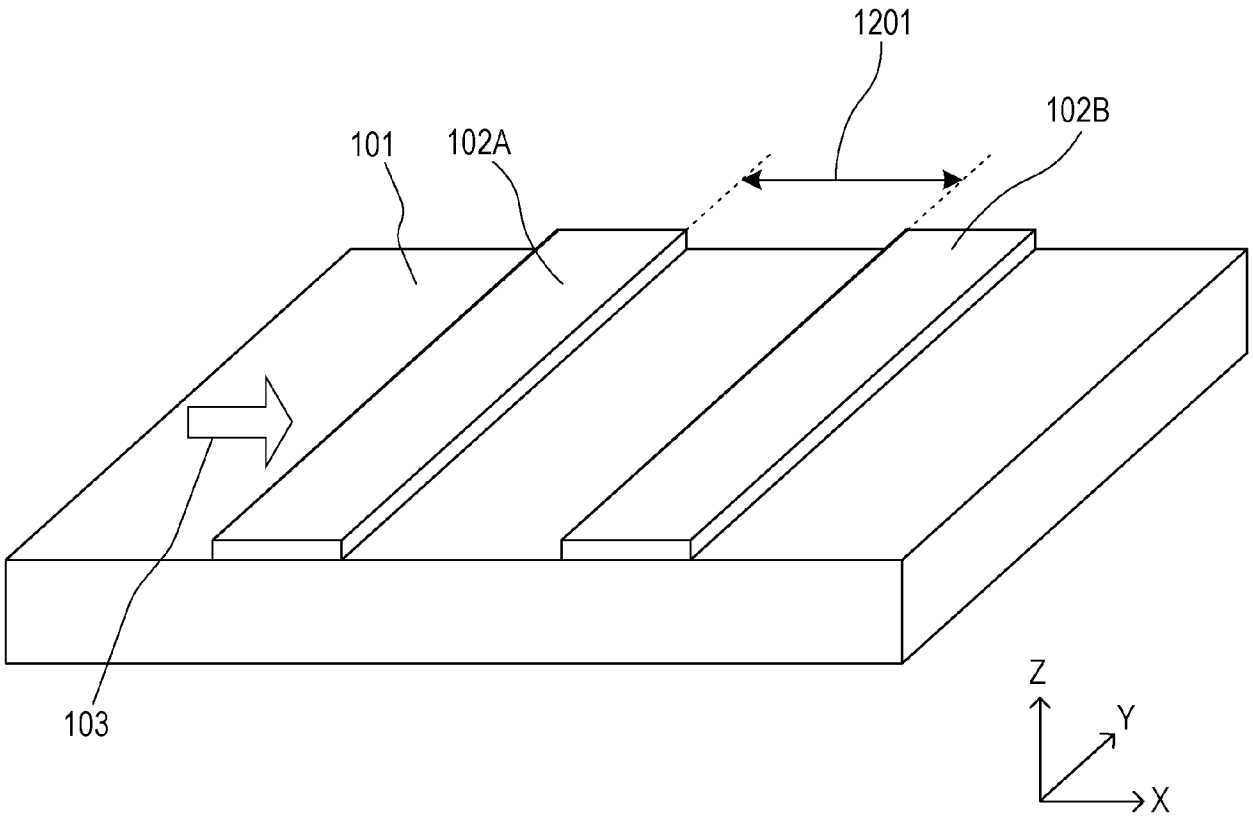
FIG. 12 is a perspective view illustrating a dielectric substrate according to a second embodiment.

FIG. 12 is a perspective view illustrating the configuration of a dielectric substrate 10 according to a second embodiment of the present disclosure.

The dielectric substrate 10 illustrated in FIG. 12 differs from that in the first embodiment (e.g., FIG. 1) in that a plurality of copper film patterns 102 (in FIG. 12, two copper film patterns 102A and 102B) are arranged on an obverse surface of a dielectric 101.

Also, in the electromagnetic-wave propagation direction 103, an arrangement distance 1201 between the copper film patterns 102A and 102B is smaller than or equal to $\lambda_0$. Also, the first dimension L in a propagation direction 103 (i.e., in an X-axis direction) of electromagnetic waves on the copper film patterns 102A and 102B satisfies equation (1) noted above.

With this configuration, since electromagnetic waves can be suppressed or reduced in each of the copper film patterns 102 arranged on the obverse surface of the dielectric 101, the effect of suppressing or reducing electromagnetic waves that propagate on the obverse surface of the dielectric substrate 10 can be more enhanced than that in the first embodiment.

Figure 13:
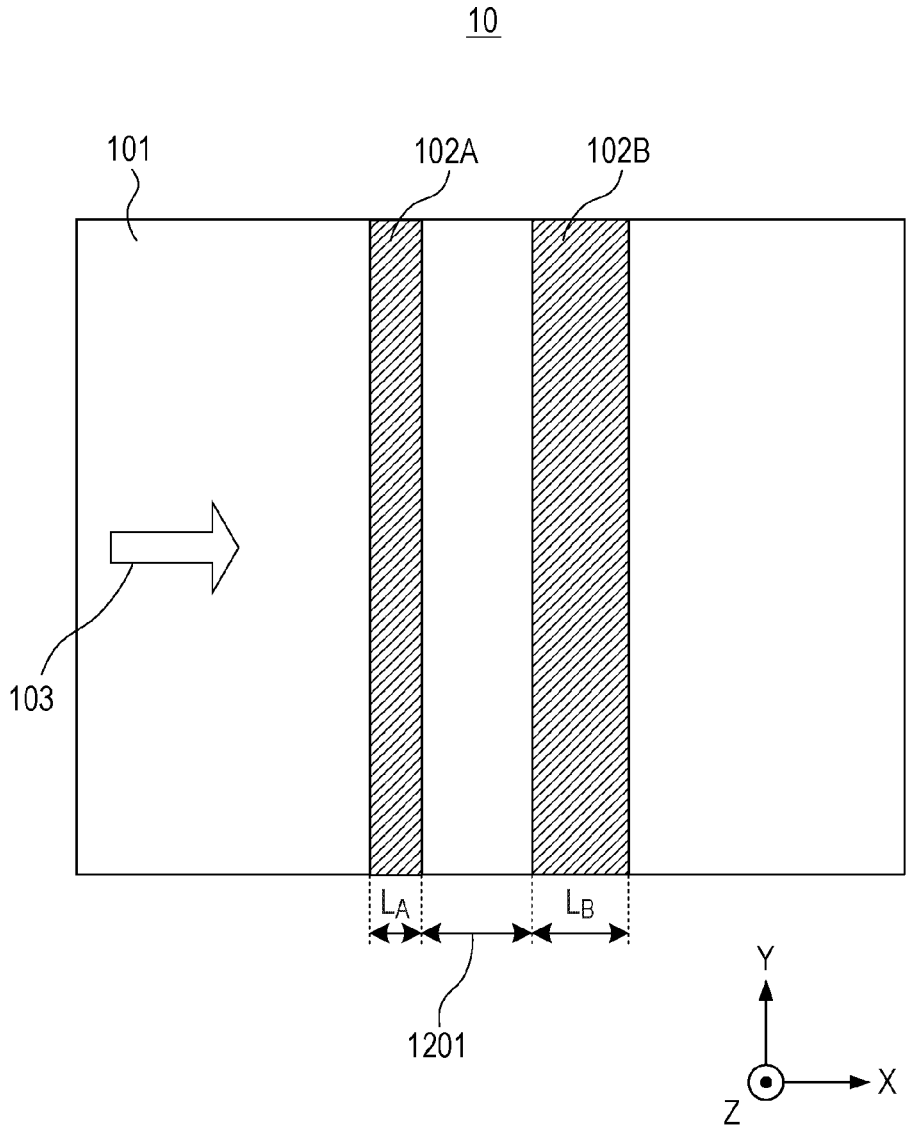
FIG. 13 is a plan view illustrating another example of the dielectric substrate according to the second embodiment.
Figure 14:
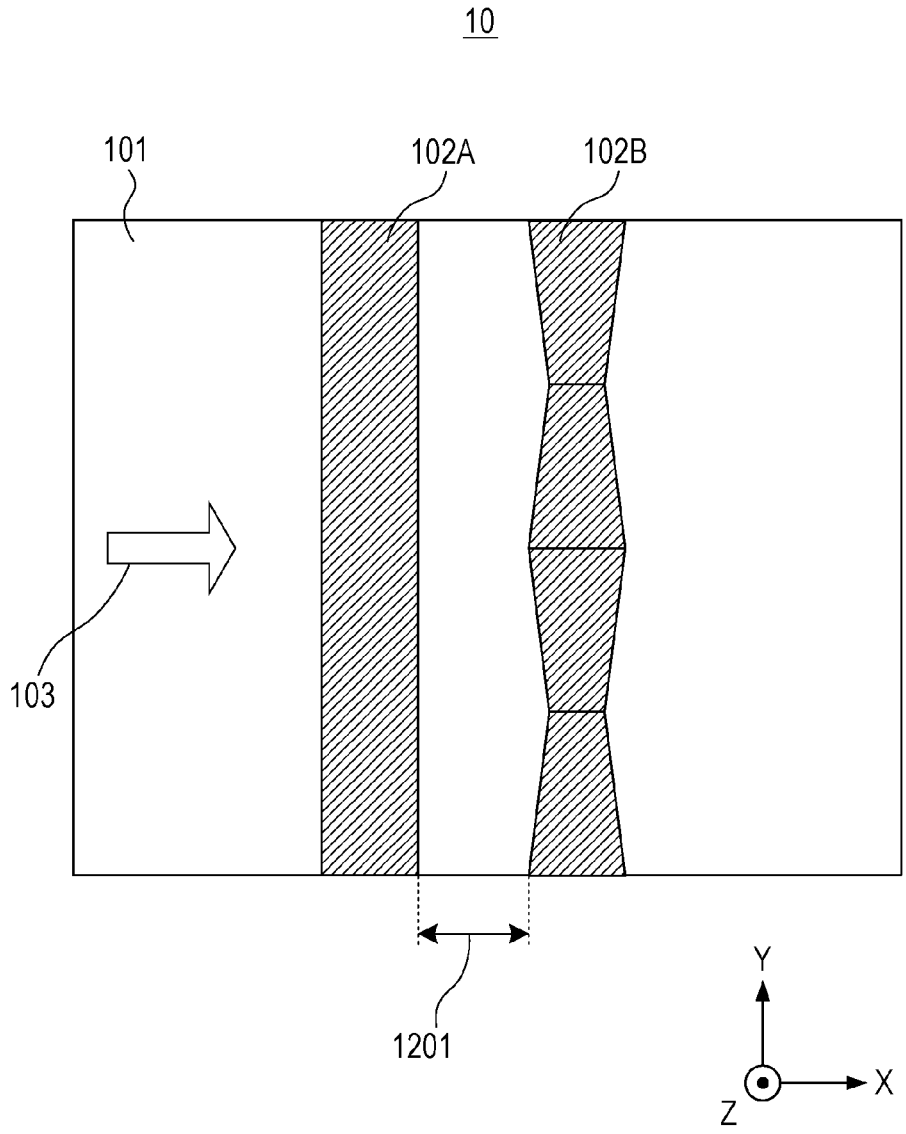
FIG. 14 is a plan view illustrating another example of the dielectric substrate according to the second embodiment.

The shapes of the copper film patterns 102 do not necessarily have to be the same. For example, as illustrated in FIG. 13, the value of a first dimension $L_A$ of the copper film pattern 102A and the value of a first dimension $L_B$ of the copper film pattern 102B in the electromagnetic-wave propagation direction 103 may be different from each other. Alternatively, as illustrated in FIG. 14, a copper film pattern 102A in which the first dimension in the electromagnetic-wave propagation direction 103 is uniform and a copper film pattern 102B in which the first dimension in the electromagnetic-wave propagation direction 103 is not uniform may be arranged on the obverse surface of the dielectric 101. With this arrangement, electromagnetic waves with a plurality of frequencies can be suppressed or reduced in accordance with the first dimensions of the copper film patterns 102 in propagation directions 103 of the respective electromagnetic waves. That is, the dielectric substrate 10 makes it possible to increase a frequency band in which the effect of suppressing or reducing electromagnetic waves is obtained.

Third Embodiment

Figure 15:
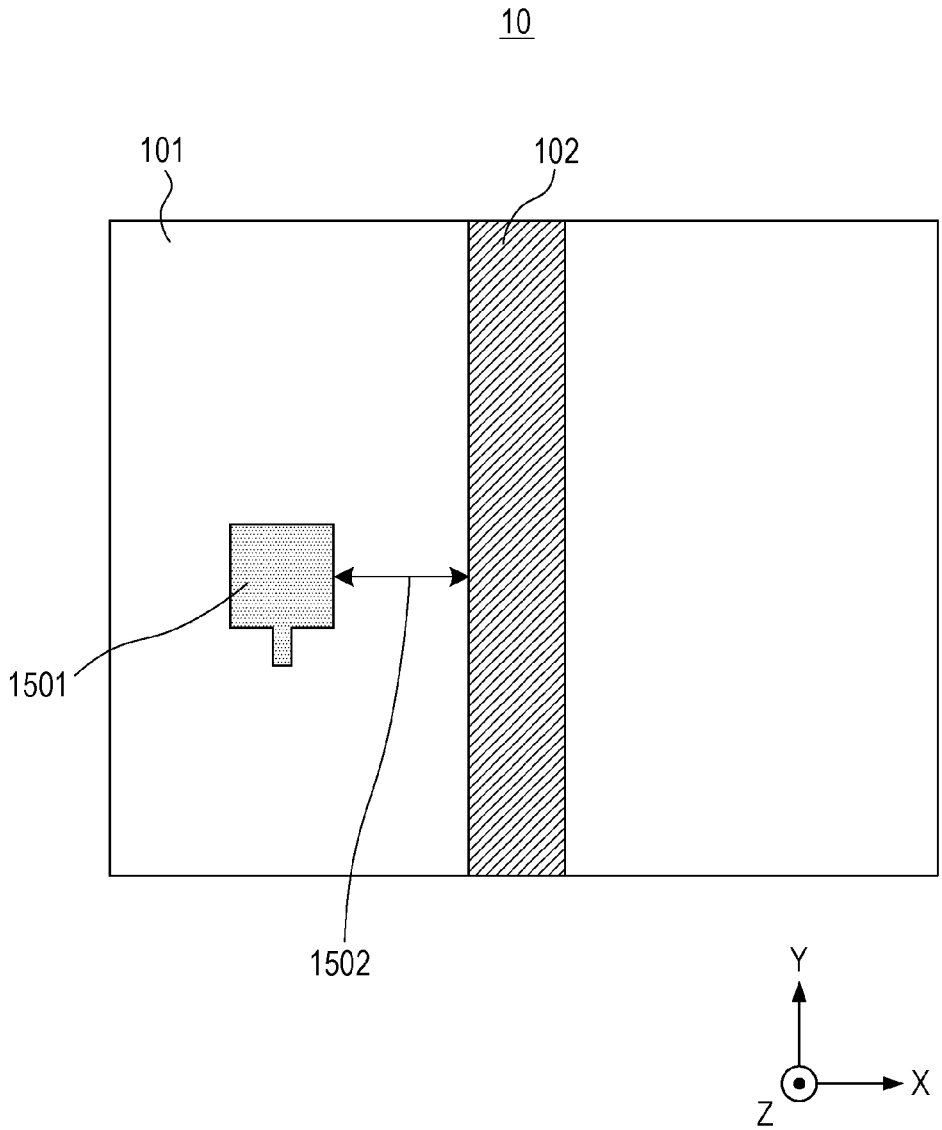
FIG. 15 is a plan view illustrating one example of a dielectric substrate according to a third embodiment.

FIG. 15 is a plan view of a dielectric substrate 10 according to a third embodiment of the present disclosure.

The dielectric substrate 10 illustrated in FIG. 15 differs from that in the first embodiment (e.g., FIG. 2) in that an antenna 1501 is arranged on an obverse surface of a dielectric 101.

The antenna 1501 radiates signals (radio waves) with a frequency $f_0$. An arrangement distance 1502 between the antenna 1501 and a copper film pattern 102 (i.e., an arrangement distance in an X-axis direction in FIG. 15) is smaller than or equal to $2\lambda_0$.

With this configuration, when the copper film pattern 102 is provided on the obverse surface of the dielectric 101, unwanted radiation emitted from the antenna 1501 can be suppressed or reduced in the X-axis direction in FIG. 15 (the X-axis direction corresponds to the electromagnetic-wave propagation direction 103 in FIG. 2).

Figure 16:
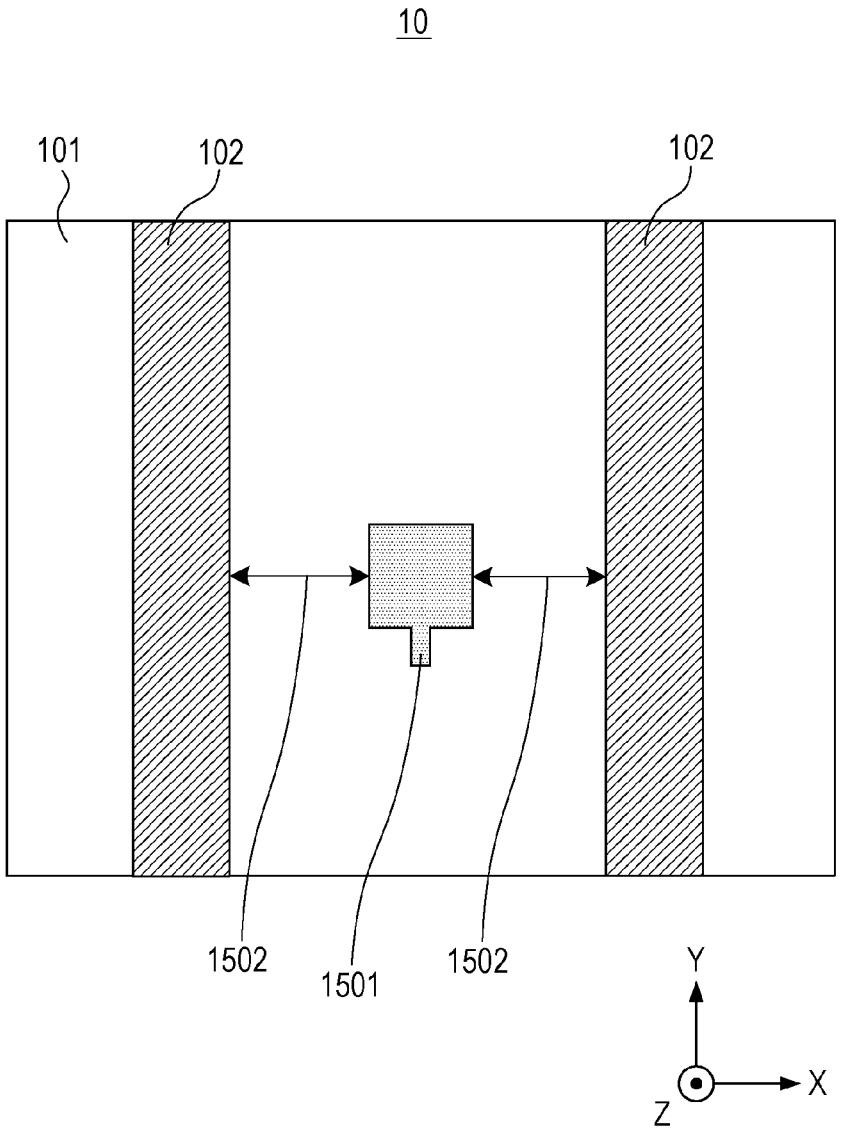
FIG. 16 is a plan view illustrating another example of the dielectric substrate according to the third embodiment.

In the dielectric substrate 10 according to the present embodiment, for example, the antenna 1501 may be arranged between adjacent copper film patterns 102, as illustrated in FIG. 16. With this arrangement, unwanted radiation emitted from the antenna 1501 can be suppressed or reduced in both positive and negative X-axis directions.

Figure 17:
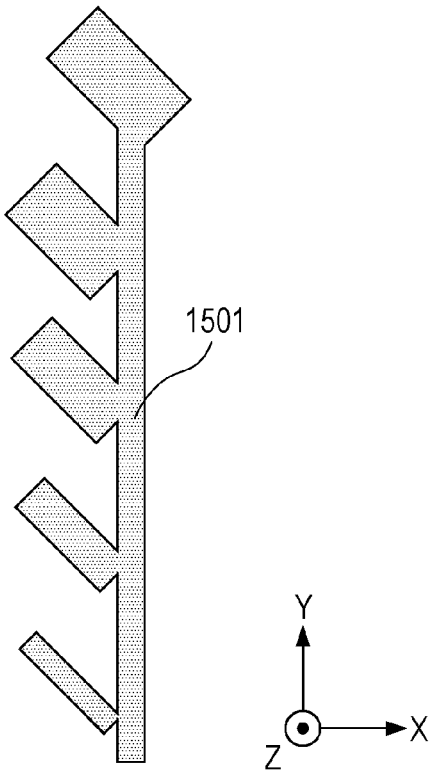
FIG. 17 is a view illustrating one example of an antenna according to the third embodiment.
Figure 18:
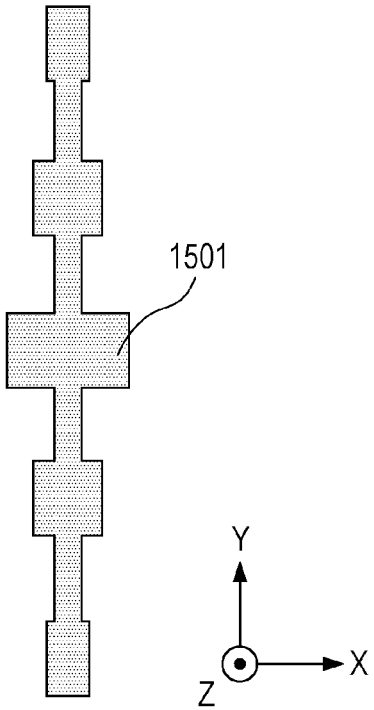
FIG. 18 is a view illustrating another example of the antenna according to the third embodiment.
Figure 19:
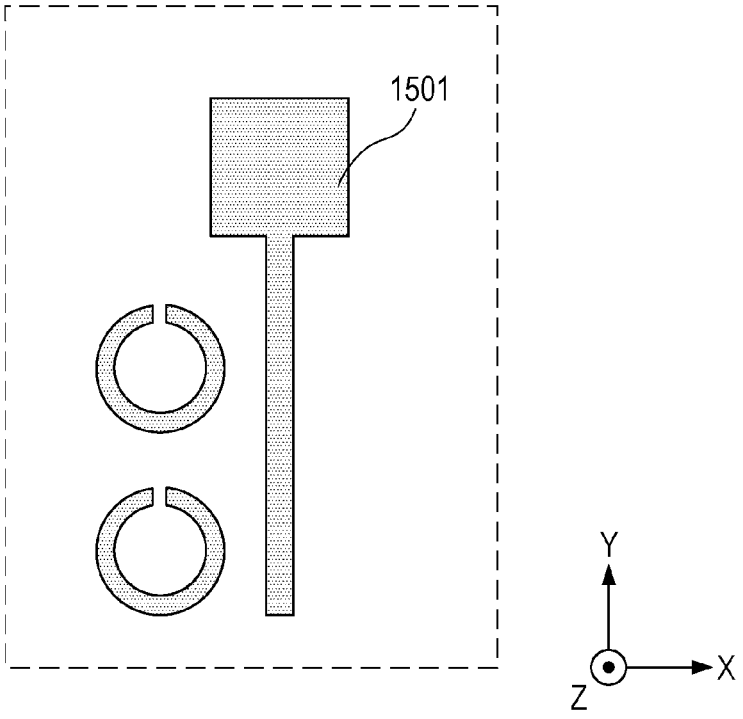
FIG. 19 is a view illustrating another example of the antenna according to the third embodiment.

Also, the antenna 1501 arranged on the dielectric 101 according to the present embodiment is not limited to the configuration illustrated in FIG. 15. The antenna 1501 may have a shape, for example, as illustrated in FIG. 17, 18, or 19, as long as it is formed of a copper film.

Fourth Embodiment

Figure 20:
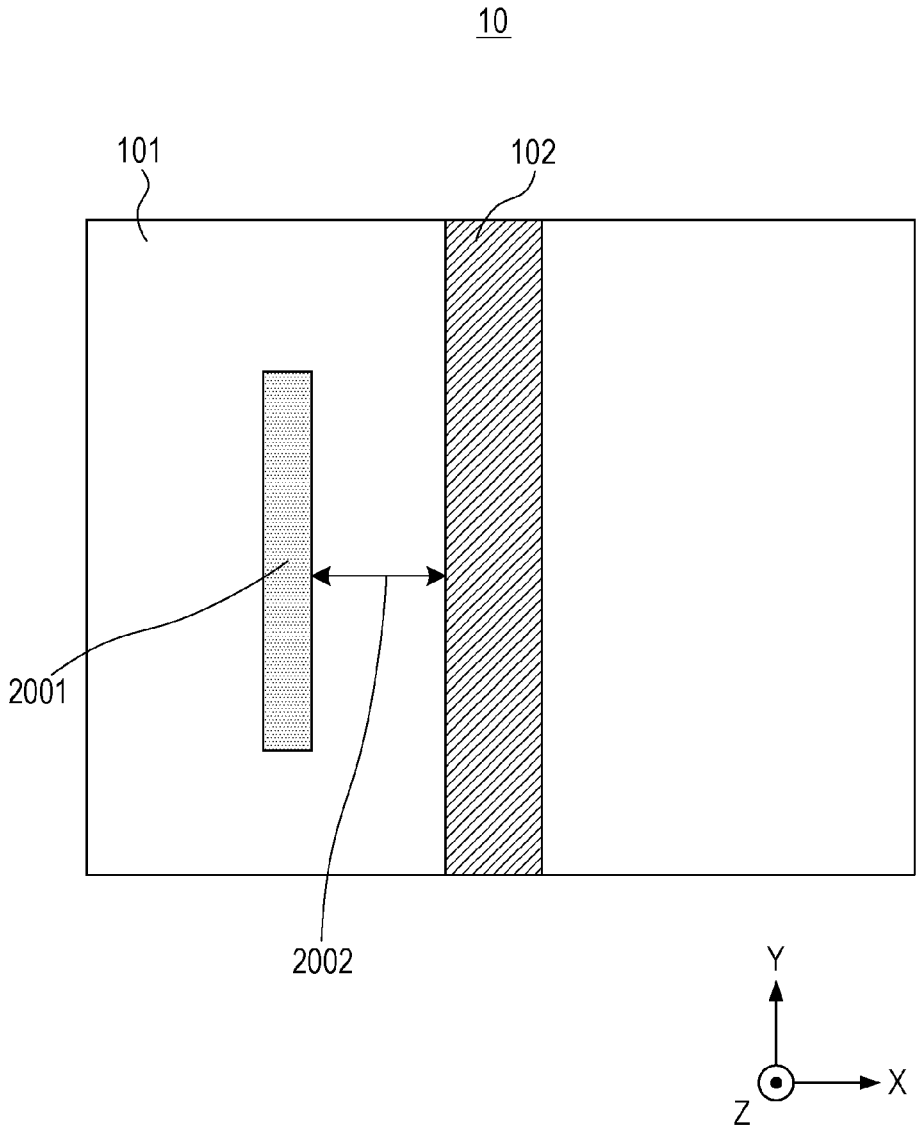
FIG. 20 is a plan view illustrating one example of a dielectric substrate according to a fourth embodiment.

FIG. 20 is a plan view of a dielectric substrate 10 according to a fourth embodiment of the present disclosure.

The dielectric substrate 10 illustrated in FIG. 20 differs from that in the third embodiment (e.g., FIG. 15) in that a transmission line 2001 is arranged on an obverse surface of a dielectric 101.

The transmission line 2001 transmits signals with a frequency $f_0$. An arrangement distance 2002 between the transmission line 2001 and a copper film pattern 102 (i.e., an arrangement distance in an X-axis direction in FIG. 20) is smaller than or equal to $2\lambda_0$.

With this configuration, the copper film pattern 102 can suppress or reduce unwanted radiation emitted from the transmission line 2001 in the X-axis direction in FIG. 20 (the X-axis direction corresponds to the electromagnetic-wave propagation direction 103 in FIG. 2).

Fifth Embodiment

Figure 21:
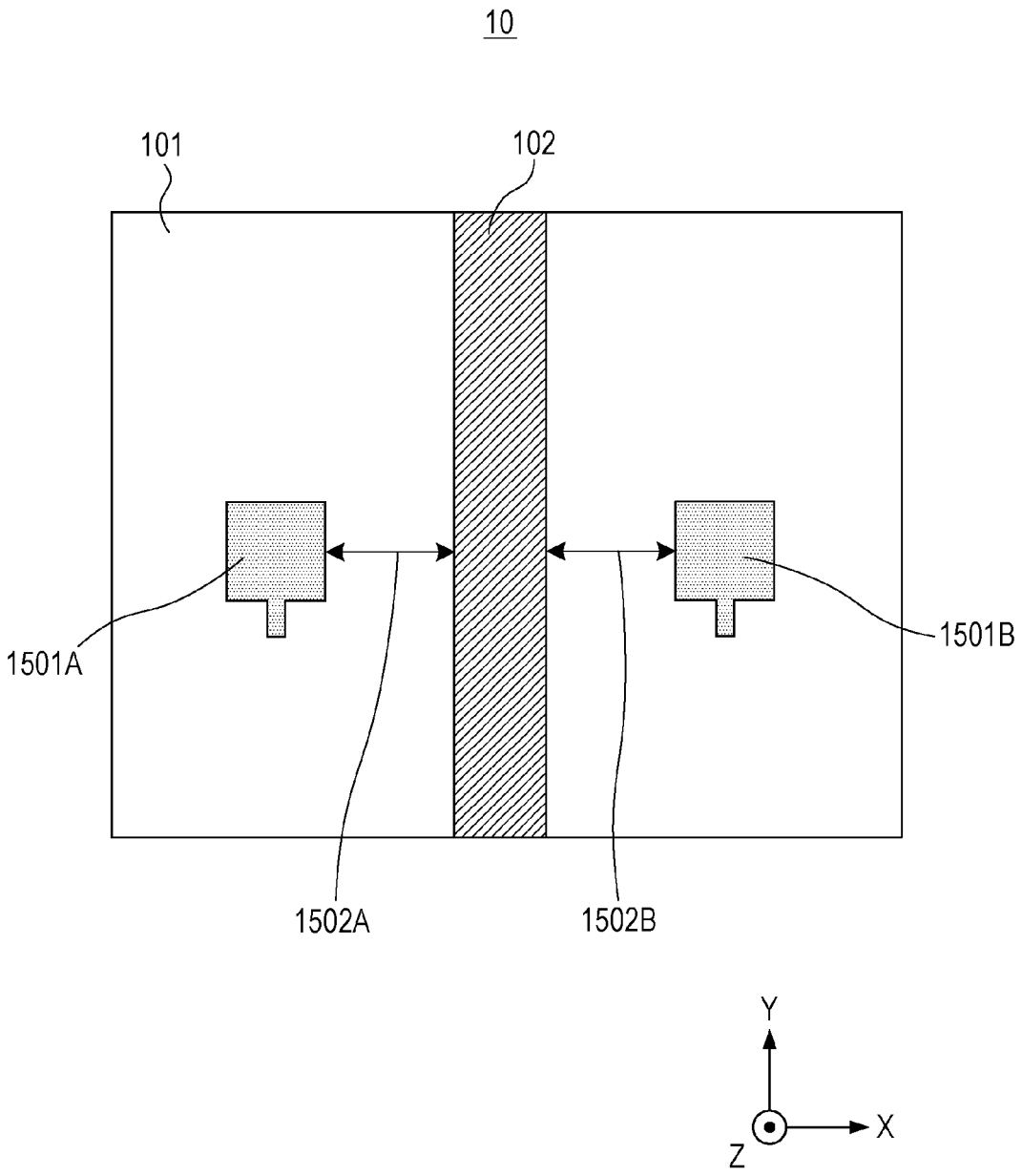
FIG. 21 is a plan view illustrating one example of a dielectric substrate according to a fifth embodiment.

FIG. 21 is a plan view of a dielectric substrate 10 according to a fifth embodiment of the present disclosure.

The dielectric substrate 10 illustrated in FIG. 21 differs from that in the third embodiment (e.g., FIG. 15) in that, on an obverse surface of a dielectric 101, antennas 1501A and 1501B are arranged in X-axis positive and negative directions of a copper film pattern 102, and the copper film pattern 102 is arranged between the antennas 1501A and 1501B.

The following description will be given of an example in which the antenna 1501A is a transmitting antenna and the antenna 1501B is a receiving antenna. In this, in the X-axis direction in FIG. 21, an arrangement distance 1502A between the antenna 1501A and the copper film pattern 102 is smaller than or equal to $2\lambda_0$ (where $\lambda_0$ represents a free space wavelength of signals radiated from the antenna 1501A). With this arrangement, the copper film pattern 102 can suppress or reduce unwanted radiation emitted from the antenna 1501A, thus making it possible to improve isolation. The antenna 1501A may be used as a receiving antenna, and the antenna 1501B may be used as a transmitting antenna. When the antenna 1501A is used as a receiving antenna, and the antenna 1501B is used as a transmitting antenna, an arrangement distance 1502B may be set according to a free space wavelength of signals radiated from the antenna 1501B, as in the case in which the antenna 1501A is used as a transmitting antenna, and the antenna 1501B is used as a receiving antenna.

Figure 22:
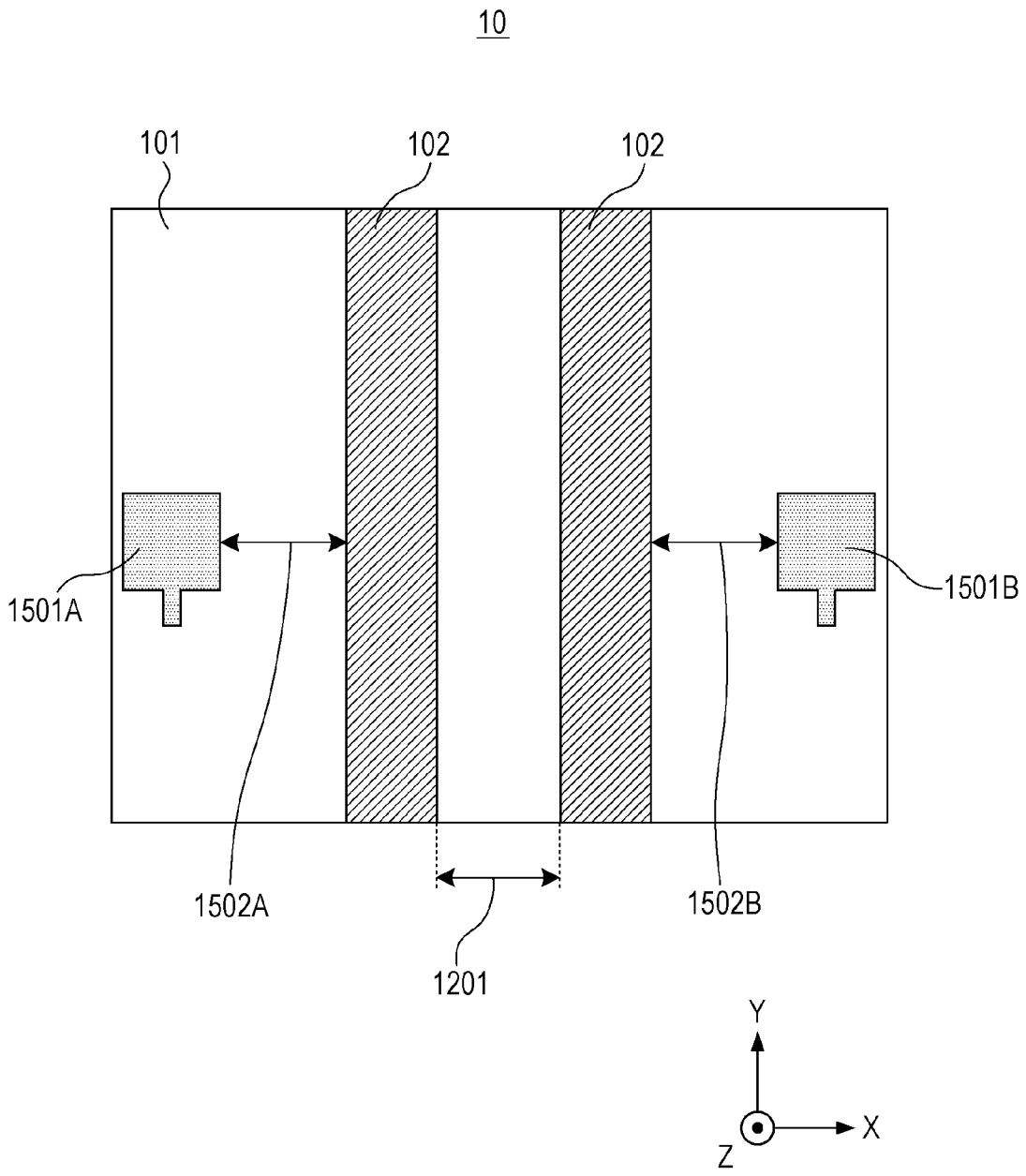
FIG. 22 is a plan view illustrating another example of the dielectric substrate according to the fifth embodiment.

In the present embodiment, a plurality of copper film patterns 102 may be arranged between the antenna 1501A and the antenna 1501B, as illustrated in FIG. 22. With this arrangement, it is possible to enhance the isolation-improving effect provided by the copper film patterns 102.

Sixth Embodiment

Figure 23:
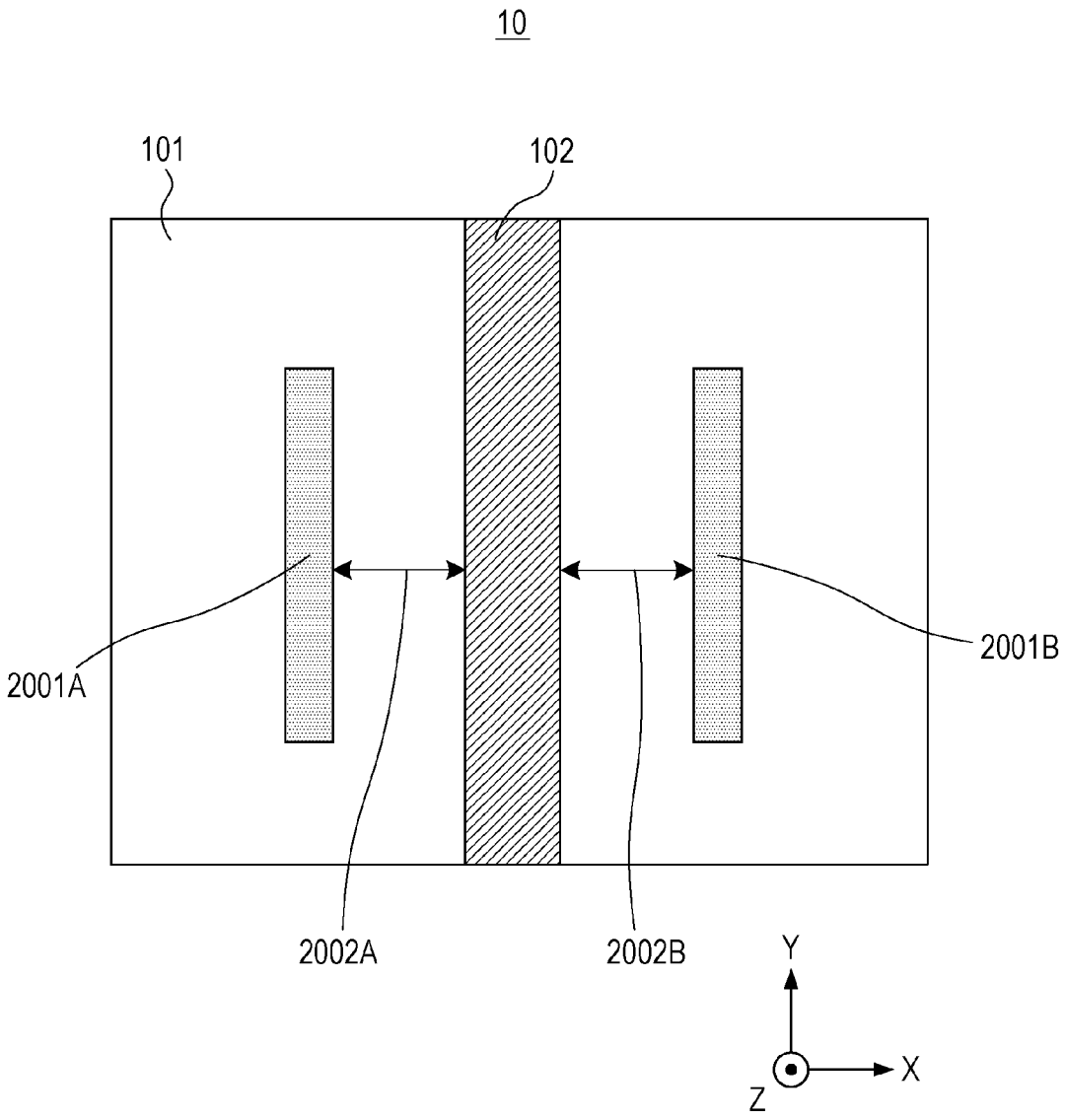
FIG. 23 is a plan view illustrating one example of a dielectric substrate according to a sixth embodiment.

FIG. 23 is a plan view of a dielectric substrate 10 according to a sixth embodiment of the present disclosure.

The dielectric substrate 10 in FIG. 23 differs from that in the fifth embodiment (e.g., FIG. 21) in that transmission lines 2001A and 2001B are arranged on a dielectric 101, and a copper film pattern 102 is arranged between the transmission lines 2001A and 2001B. An arrangement distance 2002A between the transmission line 2001A and the copper film pattern 102 (i.e., an arrangement distance in an X-axis direction in FIG. 23) may be smaller than or equal to $2\lambda_0$, as in FIG. 20. An arrangement distance 2002B between the transmission line 2001B and the copper film pattern 102 (i.e., an arrangement distance in the X-axis direction in FIG. 23) may be smaller than or equal to $2\lambda_0$, as in FIG. 20.

For example, when the copper film pattern 102 is provided between the transmission lines 2001A and 2001B, and different signals are transmitted through the transmission lines 2001A and 2001B, it is possible to suppress or reduce unwanted radiation emitted from each of the transmission lines 2001A and 2001B, and it is possible to reduce crosstalk noise.

In this case, a first dimension L of the copper film pattern 102 in an X-axis direction is determined by the frequency $f_0$ of signals transmitted through the transmission line 2001A or 2001B (e.g., see equation (1)). For example, when the copper film pattern 102 is provided between the transmission lines 2001A and 2001B, signals with a frequency $f_0$ are transmitted through the transmission line 2001A, and signals with a frequency $f_1$ are transmitted through the transmission line 2001B, the copper film pattern 102 can suppress or reduce unwanted radiation emitted from the transmission line 2001A.

Figure 24:
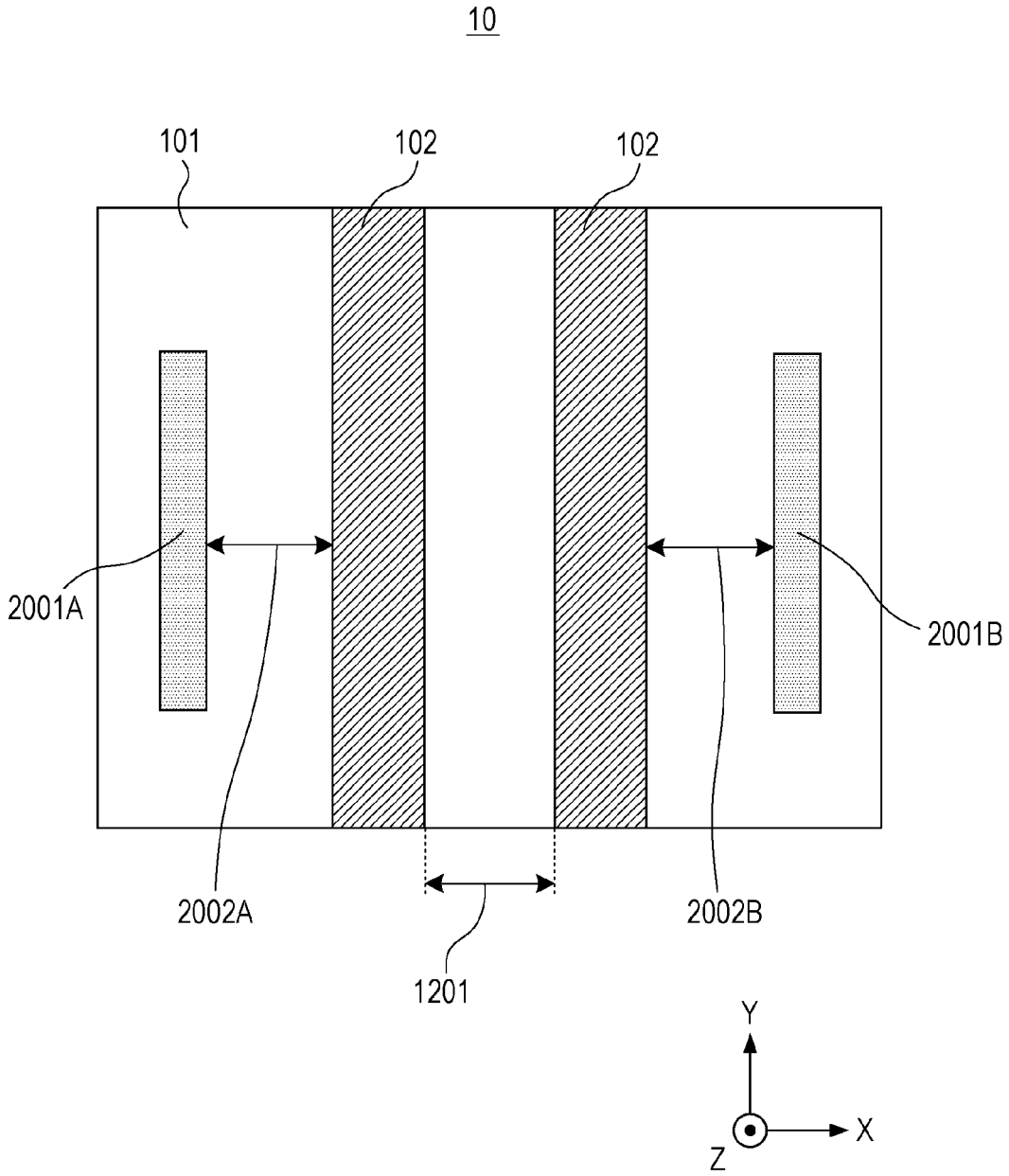
FIG. 24 is a plan view illustrating another example of the dielectric substrate according to the sixth embodiment.

In the present embodiment, a plurality of copper film patterns 102 may be arranged between the transmission lines 2001A and 2001B, as in FIG. 24. With this arrangement, it is possible to enhance the crosstalk-noise reducing effect provided by the copper film pattern 102.

The present disclosure can be realized by software, hardware, or software in cooperation with hardware.

Each functional block used in the description of each embodiment described above can be partly or entirely realized by an LSI such as an integrated circuit, and each process described in each embodiment may be controlled partly or entirely by the same LSI or a combination of LSIs. The LSI may be individually formed as chips, or one chip may be formed so as to include a part or all of the functional blocks. The LSI may include a data input and output coupled thereto. The LSI here may be referred to as an IC, a system LSI, a super LSI, or an ultra LSI depending on a difference in the degree of integration.

However, the technique of implementing an integrated circuit is not limited to the LSI and may be realized by using a dedicated circuit, a general-purpose processor, or a special-purpose processor. In addition, a field programmable gate array (FPGA) that can be programmed after the manufacture of the LSI or a reconfigurable processor in which the connections and the settings of circuit cells arranged inside the LSI can be reconfigured may be used. The present disclosure can be realized as digital processing or analogue processing.

If future integrated circuit technology replaces LSIs as a result of the advancement of semiconductor technology or other derivative technology, the functional blocks could be integrated using the future integrated circuit technology. Biotechnology can also be applied.

One aspect of the present disclosure can be applied to a dielectric substrate that transmits signals with a frequency $f_0$ and that suppresses or reduces electromagnetic waves that propagate on an obverse surface of a dielectric substrate.

What is claimed is:

1. A dielectric substrate, comprising:

a dielectric; and a copper film pattern arranged on a first surface of the dielectric, wherein an antenna configured to radiate a signal with a frequency $f_0$ is arranged on the first surface, and wherein the copper film pattern has a first dimension L in a direction parallel to a propagation direction of an electromagnetic wave that has the frequency $f_0$ and that propagates on the first surface, and the first dimension L is given by:

$$L = \frac{1}{\sqrt{\varepsilon_r} - 1} k\lambda_0$$

where $\varepsilon_r$ represents a relative permittivity of the dielectric, k represents a constant in a range of 0.15 to 0.70, and $\lambda_0$ represents a free space wavelength of the signal, and wherein, in the propagation direction of the electromagnetic wave, a distance between the antenna and the copper film pattern is smaller than or equal to $2\lambda_0$.

2. The dielectric substrate according to claim 1, wherein the copper film pattern arranged on the first surface comprises a plurality of copper film patterns, and in the propagation direction of the electromagnetic wave, a distance between adjacent copper film patterns of the plurality of copper film patterns is smaller than or equal to $\lambda_0$.

3. The dielectric substrate according to claim 1, wherein the copper film pattern has a second dimension in a direction orthogonal to the propagation direction of the electromagnetic wave, and the second dimension is larger than $\lambda_0/2$.

4. The dielectric substrate according to claim 1, wherein the antenna arranged on the first surface comprises a plurality of antennas, and the copper film pattern is arranged between at least two antennas of the plurality of antennas.

5. The dielectric substrate according to claim 1, wherein the copper film pattern includes a plurality of copper film patterns, the antenna is positioned between adjacent copper film patterns of the plurality of copper film patterns, and a distance, in the propagation direction of the electromagnetic wave, between the antenna and each of the adjacent copper film patterns is smaller than or equal to $2\lambda_0$.

6. The dielectric substrate according to claim 1, wherein a transmission line for transmitting the signal with the frequency $f_0$ is arranged on the first surface, and in the propagation direction of the electromagnetic wave, a distance between the transmission line and the copper film pattern is smaller than or equal to $2\lambda_0$.

7. The dielectric substrate according to claim 6, wherein the transmission line arranged on the first surface comprises a plurality of transmission lines, and the copper film pattern is arranged between at least two transmission lines of the plurality of transmission lines.

8. A radar device comprising the dielectric substrate of claim 1.

9. An antenna device comprising:

a dielectric;

an antenna arranged on a first surface of the dielectric, the antenna configured to radiate a signal with a frequency $f_0$; and a copper film pattern arranged on the first surface, wherein the copper film pattern has a first dimension L in a direction parallel to a propagation direction of an electromagnetic wave that has the frequency $f_0$ and that propagates on the first surface, and the first dimension L is given by:

$$L = \frac{1}{\sqrt{\varepsilon_r} - 1} k\lambda_0$$

where $\varepsilon_r$ represents a relative permittivity of the dielectric, k represents a constant in a range of 0.15 to 0.70, and $\lambda_0$ represents a free space wavelength of the signal, and wherein, in the propagation direction of the electromagnetic wave, a distance between the antenna and the copper film pattern is smaller than or equal to $2\lambda_0$.

10. The antenna device according to claim 9, wherein the copper film pattern includes a plurality of copper film patterns, the antenna is positioned between adjacent copper film patterns of the plurality of copper film patterns, and a distance, in the propagation direction of the electromagnetic wave, between the antenna and each of the adjacent copper film patterns is smaller than or equal to $2\lambda_0$.

11. The antenna device according to claim 9, wherein the copper film pattern arranged on the first surface includes a plurality of copper film patterns, and, in the propagation direction of the electromagnetic wave, a distance between adjacent copper film patterns of the plurality of copper film patterns is smaller than or equal to $\lambda_0$.

12. The antenna device according to claim 9, wherein the antenna includes a plurality of antennas, and the copper film pattern is arranged between at least two antennas of the plurality of antennas.

13. The antenna device according to claim 9, further comprising:

a transmission line arranged on the first surface, wherein the transmission line is configured to transmit the signal with the frequency $f_0$, and, in the propagation direction of the electromagnetic wave, a distance between the transmission line and the copper film pattern is smaller than or equal to $2\lambda_0$.

14. The antenna device according to claim 13, wherein the transmission line arranged on the first surface includes a plurality of transmission lines, and the copper film pattern is arranged between at least two transmission lines of the plurality of transmission lines.

15. The antenna device according to claim 9, wherein the copper film pattern has a second dimension in a direction orthogonal to the propagation direction of the electromagnetic wave, and the second dimension is larger than $\lambda_0/2$.

* * * * *